US011433678B2

(12) United States Patent
Oki

(10) Patent No.: US 11,433,678 B2
(45) Date of Patent: Sep. 6, 2022

(54) LIQUID CARTRIDGE INCLUDING FIRST AND SECOND VALVES DISPOSED IN LIQUID SUPPLY PORTION, AND SYSTEM USING THE SAME

(71) Applicant: BROTHER KOGYO KABUSHIKI KAISHA, Nagoya (JP)

(72) Inventor: Satoru Oki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 69 days.

(21) Appl. No.: 17/130,071

(22) Filed: Dec. 22, 2020

(65) Prior Publication Data

US 2021/0245519 A1 Aug. 12, 2021

(30) Foreign Application Priority Data

Feb. 6, 2020 (JP) ..... JP2020-018485

(51) Int. Cl.
*B41J 2/175* (2006.01)

(52) U.S. Cl.
CPC ..... *B41J 2/17523* (2013.01); *B41J 2/17506* (2013.01); *B41J 2/17596* (2013.01)

(58) Field of Classification Search
CPC .... B41J 2/175; B41J 2/17506; B41J 2/17509; B41J 2/17513; B41J 2/17523; B41J 2/17546; B41J 2/1753; B41J 2/17553; B41J 2/17596
See application file for complete search history.

(56) References Cited

U.S. PATENT DOCUMENTS 5,893,391 A * 4/1999 Jenski, Jr. ..... F16L 37/32 137/614.04
2005/0146579 A1* 7/2005 Sasaki ..... B41J 2/17509 347/86
2011/0242233 A1 10/2011 Hirano et al.
2011/0249065 A1 10/2011 Hirano et al.
2015/0290948 A1 10/2015 Ohnishi

FOREIGN PATENT DOCUMENTS

JP 2011-156726 A 8/2011
JP 2014-100813 A 6/2014

* cited by examiner

*Primary Examiner* — Anh T Vo
(74) *Attorney, Agent, or Firm* — Merchant & Gould P.C.

(57) ABSTRACT

A liquid cartridge includes: a cartridge body; a liquid supply portion; a sealing member having a through-hole; first and second valves; and first and second urging members. The liquid supply portion defines therein a liquid passage extending in a frontward direction and having an opening open frontward. The sealing member is provided on a periphery of the opening of the liquid supply portion, and has first and second surfaces those face rearward. The first and second valves are disposed in the liquid passage so as to be movable in the frontward direction and a rearward direction. The first valve is pressed by the first urging member to abut the first surface and interrupts communication between the through-hole and the liquid passage. The second valve is urged by the second urging member to abut the second surface and interrupts communication between the through-hole and an outside of the liquid supply portion.

19 Claims, 9 Drawing Sheets

LIQUID CARTRIDGE INCLUDING FIRST AND SECOND VALVES DISPOSED IN LIQUID SUPPLY PORTION, AND SYSTEM USING THE SAME

CROSS REFERENCE TO RELATED APPLICATION

This application claims priority from Japanese Patent Application No. 2020-018485 filed Feb. 6, 2020. The entire content of the priority application is incorporated herein by reference.

TECHNICAL FIELD

The present disclosure relates to a liquid cartridge storing liquid therein, and a system including the liquid cartridge and an attachment section to which the liquid cartridge is attachable.

BACKGROUND

There has been known an ink cartridge and a system including the ink cartridge and an attachment section to which the ink cartridge is attachable. As an example of the above liquid cartridge and system, a system including an ink cartridge and an inkjet recording apparatus including an attachment section to which the ink cartridge is attachable and from which the ink cartridge is detachable.

The ink cartridge includes a valve movable to open and close an ink supply opening. In a state where the ink cartridge is not attached to the attachment section, the valve closes the ink supply opening to prevent ink stored in the ink cartridge from leaking outside through the ink supply opening. During a process of attachment of the ink cartridge to the attachment section, the valve is moved to open the ink supply opening. Through this operation, the ink stored in the ink cartridge is allowed to be supplied to the attachment section through the ink supply opening.

As a structure for securely preventing ink stored in an ink cartridge from leaking outside through an ink supply opening, Japanese Patent Application Publication No. 2011-156726 discloses an ink cartridge including two valves, and Japanese Patent Application Publication No. 2014-100813 discloses an ink supplying device including two valves.

SUMMARY

With the conventional ink cartridge disclosed in Japanese Patent Application Publication No. 2011-156726 and the ink supplying device disclosed in Japanese Patent Application Publication No. 2014-100813, two valves are configured to open and close openings, respectively, those are formed in members different from each other.

Specifically, according to the ink cartridge described in Japanese Patent Application Publication No. 2011-156726, a first valve is configured to open and close a slit formed in a lid, and a second valve is configured to open and close an opening formed in a tubular member different from the lid. Further, according to the ink supplying device described in Japanese Patent Application Publication No. 2014-100813, an outer valve and an inner valve are configured to open and close openings defined by discrete valve seats. Hence, respective valves require respective components, which renders a resultant structure complex and increase in size.

In view of the foregoing, it is an object of the present disclosure to provide a liquid cartridge capable of suppressing leakage of liquid to an outside while avoiding complex structure and increase in size thereof, and a system including the above liquid cartridge and an attachment section to which the cartridge is attachable.

In order to attain the above and other objects, according to one aspect, the disclosure provides a liquid cartridge including: a cartridge body; a liquid supply portion; a sealing member; a first valve; a second valve; a first urging member; and a second urging member. The cartridge body defined therein a liquid storage chamber. The liquid supply portion extends in a frontward direction crossing a gravitational direction from the cartridge body in an upright posture of the liquid cartridge. The liquid supply portion is formed with an opening open frontward in the upright posture. The liquid supply portion defines therein a liquid passage connecting the liquid storage chamber to the opening. The sealing member is formed with a through-hole penetrating the sealing member in the frontward direction in the upright posture. The sealing member is provided on a periphery of the opening of the liquid supply portion. The sealing member has: a first surface; and a second surface. The first surface is positioned radially outward of a periphery of the through-hole. The first surface faces rearward in the upright posture. The second surface is positioned radially inward of the first surface. The second surface is positioned frontward of the first surface and facing rearward in the upright posture. The first valve is disposed in the liquid passage so as to be movable in the frontward direction and a rearward direction opposite the frontward direction. The second valve is disposed in the liquid passage so as to be movable in the frontward direction and the rearward direction. The first urging member urges the first valve frontward. The second urging member urges the second valve frontward. The first valve is configured to abut against the first surface by an urging force of the first urging member to interrupt communication between the through-hole and the liquid passage. The second valve is configured to abut against the second surface by an urging force of the second urging member to interrupt communication between the through-hole and an outside of the liquid supply portion.

According to another aspect, the disclosure provides a system configured of a liquid cartridge and an attachment section to which the liquid cartridge is attachable in a frontward direction crossing a gravitational direction. The liquid cartridge includes: a cartridge body; a liquid supply portion; a sealing member; a first valve; a second valve; a first urging member; and a second urging member. The cartridge body defined therein a liquid storage chamber. The liquid supply portion extends in the frontward direction crossing a gravitational direction from the cartridge body in an upright posture of the liquid cartridge. The liquid supply portion is formed with an opening open frontward in the upright posture. The liquid supply portion defines therein a liquid passage connecting the liquid storage chamber to the opening. The sealing member is formed with a through-hole penetrating the sealing member in the frontward direction in the upright posture. The sealing member is provided on a periphery of the opening of the liquid supply portion. The sealing member has: a first surface; and a second surface. The first surface is positioned radially outward of a periphery of the through-hole. The first surface faces rearward in the upright posture. The second surface is positioned radially inward of the first surface. The second surface is positioned frontward of the first surface and facing rearward in the upright posture. The first valve is disposed in the liquid passage so as to be movable in the frontward direction and a rearward direction opposite the frontward direction. The second valve is disposed in the liquid passage so as to be movable in the frontward direction and the rearward direction. The first urging member urges the first valve frontward. The second urging member urges the second valve frontward. The attachment section includes: a tubular member; a third valve; and a third urging member. The tubular member extends rearward to have an open end in the rearward direction. The tubular member is configured to be inserted into the liquid passage of the liquid supply portion of the liquid cartridge attached to the attachment section. The third valve is disposed in the tubular member and movable between: an open position in which an entire portion of the third valve is disposed in the tubular member to open the open end; and a closed position in which a portion of the third valve protrudes further rearward than the open end to close the open end. The third urging member urges the third valve toward the closed position. The first valve is configured to abut against the first surface by an urging force of the first urging member to interrupt communication between the through-hole and the liquid passage. The second valve is configured to abut against the second surface by an urging force of the second urging member to interrupt communication between the through-hole and an outside of the liquid supply portion. During a process of attachment of the liquid cartridge to the attachment section: the tubular member is inserted through the through-hole while no gap is between the tubular member and the periphery of the through-hole; the second valve is configured to be pressed by the third valve to be moved rearward to separate from the second surface; and the first valve is configured to be pressed by the tubular member to be moved rearward to separate from the first surface.

According to still another aspect, the disclosure provides a liquid container including: a housing; a liquid supply portion; a sealing member; a first valve; a second valve; a first urging member; and a second urging member. The housing defines therein a liquid storage chamber. The liquid supply portion has an opening and a liquid passage connecting the liquid storage chamber to the opening. The sealing member is formed with a through-hole penetrating the sealing member. The sealing member is provided on a periphery of the opening of the liquid supply portion. The sealing member has: a first surface; and a second surface. The first surface is positioned radially outward of a periphery of the through-hole. The second surface is positioned radially inward of the first surface. The first valve is disposed in the liquid passage and configured to be positioned at one of: a first abutment position in which the first valve abuts against the first surface; and a first separated position in which the first valve is separated from the first surface. The second valve is disposed in the liquid passage and configured to be positioned at one of: a second abutment position in which the second valve abuts against the second surface; and a second separated position in which the second valve is separated from the second surface. The first urging member urges the first valve toward the first abutment position; and a second urging member urges the second valve toward the second abutment position.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, one embodiment of the present disclosure will be described with reference to FIGS. 1 through 9. It would be apparent to those skilled in the art that the embodiment described below is merely an example of the present disclosure and modifications and variations may be made thereto.

<Overall Configuration of Printer 10>

Figure 1:
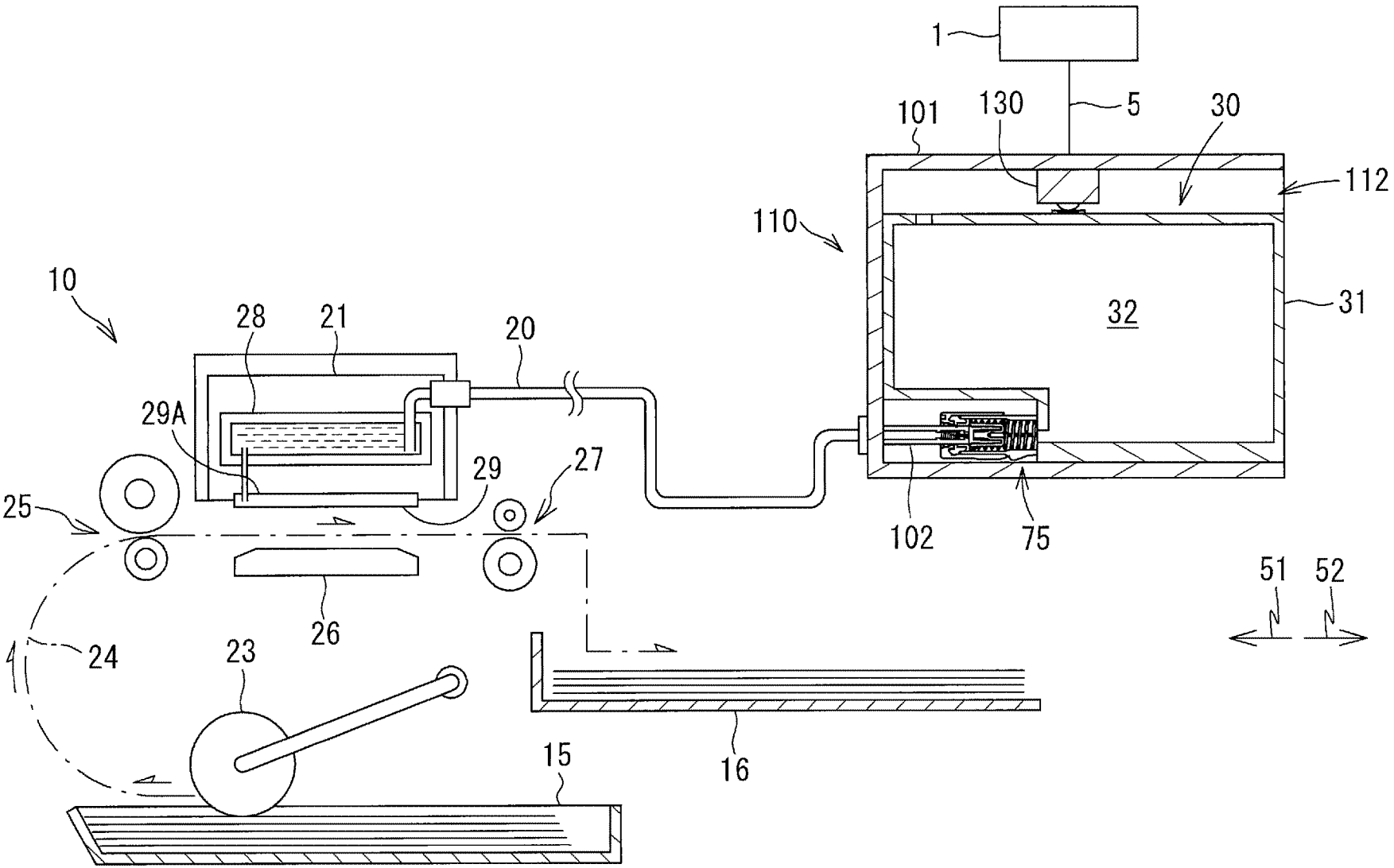
FIG. 1 is a vertical cross-sectional view schematically illustrating an internal configuration of a printer 10 to which an ink cartridge 30 according to one embodiment of the present disclosure is attached.

FIG. 1 illustrates a printer 10 configured to selectively discharge ink droplets onto recording sheets to record images thereon based on an inkjet recording scheme. The printer 10 includes a recording head 21, a cartridge attachment section 110, and ink tubes 20. The cartridge attachment section 110 is configured to receive a plurality of ink cartridges 30 each storing therein ink to be supplied to the recording head 21. The ink tubes 20 connect the recording head 21 and the cartridge attachment section 110 to each other. The cartridge attachment section 110 includes a cartridge holder 101 having one surface in which an opening 112 is formed. The ink cartridge 30 and the cartridge attachment section 110 constitutes a system of the present disclosure.

Figure 9:
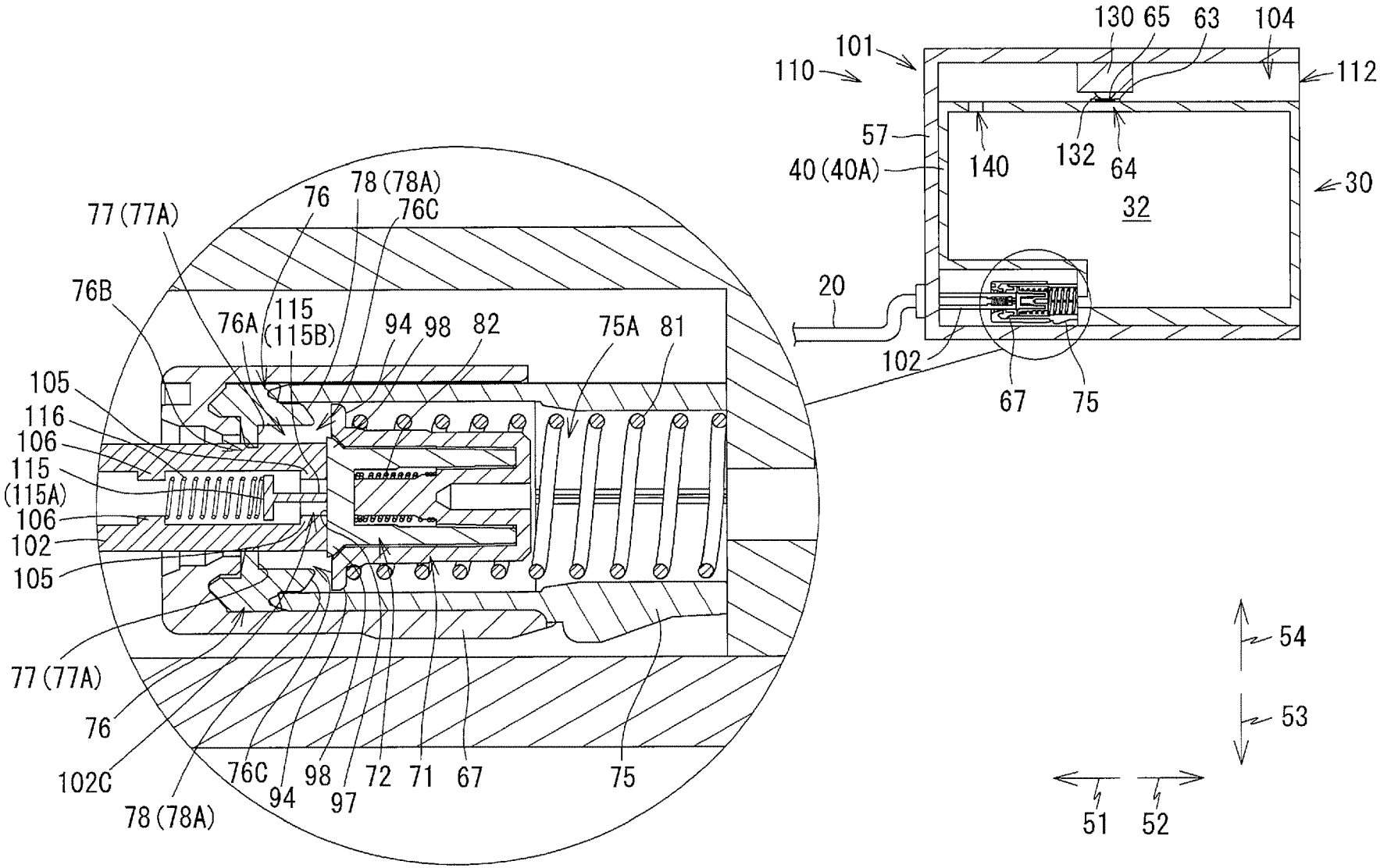
FIG. 9 is a vertical cross-sectional view of the ink cartridge 30 and the cartridge attachment section 110 according to the embodiment, and illustrating a state where the ink cartridge 30 has been completely attached to the cartridge attachment section 110.

Each of the ink cartridges 30 is configured to be inserted into the cartridge attachment section 110 and extracted from the cartridge attachment section 110 through the opening 112. FIG. 1 illustrates an attachment state of the ink cartridge 30 in which the ink cartridge 30 has been completely inserted into the cartridge attachment section 110. FIG. 9 illustrates the ink cartridge 30 illustrated in FIG. 1 and the cartridge attachment section 110. That is, FIG. 9 illustrates the attachment state of the ink cartridge 30.

In the following description, a direction in which the ink cartridge 30 is inserted into the cartridge attachment section 110 is defined as a frontward direction 51. Further, a posture of the ink cartridge 30 when the ink cartridge 30 is inserted frontward into and attached to the cartridge attachment section 110 is defined as an upright posture. That is, in the attachment state of the ink cartridge 30, the ink cartridge 30 is in the upright posture. FIGS. 1, 3, 4, and 6 through 9 illustrate the upright posture of the ink cartridge 30.

A direction opposite the frontward direction 51, i.e., a direction in which the ink cartridge 30 is removed from the cartridge attachment section 110 is defined as a rearward direction 52. In the present embodiment, a horizontal direction orthogonal to a gravitational direction is defined, the horizontal direction is parallel to an insertion direction in which the ink cartridge 30 is inserted into the cartridge attachment section 110. The frontward direction 51 and the rearward direction 52 are parallel to the horizontal direction. The frontward direction 51 and the rearward direction 52 cross the gravitational direction.

Figure 3:
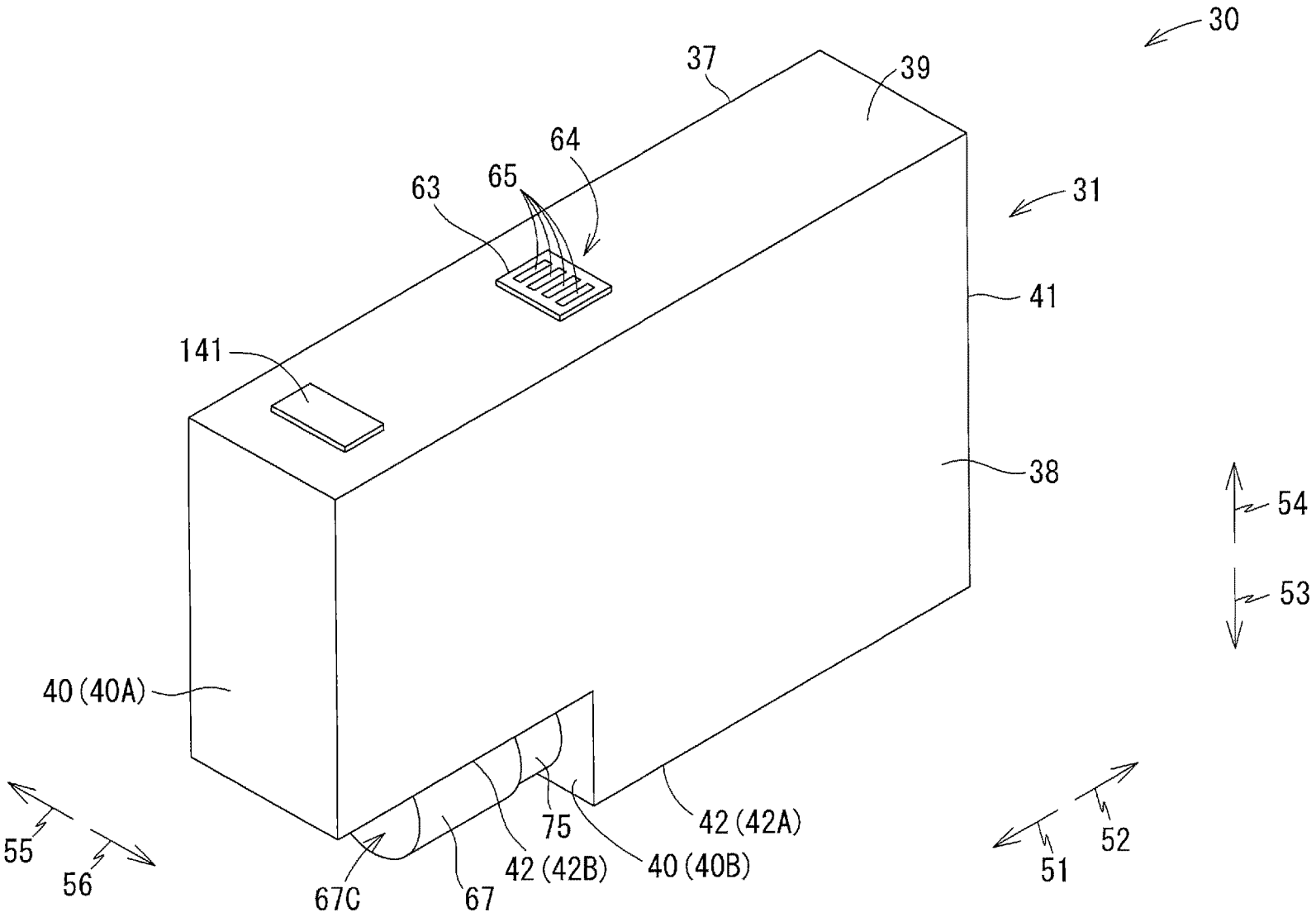
FIG. 3 is a perspective view illustrating the ink cartridge 30 according to the embodiment in an upright posture.

Further, the gravitational direction is defined as a downward direction 53, and a direction opposite the gravitational direction is defined as an upward direction 54. Still further, as illustrated in FIG. 3, directions orthogonal to the frontward direction 51 and the downward direction 53 are defined as a rightward direction 55 and a leftward direction 56. More specifically, in the upright posture of the ink cartridge 30, the direction orienting toward the right is defined as the rightward direction 55, while the direction orienting toward the left is defined as the leftward direction 56 when the ink cartridge 30 is viewed from a rear side thereof.

Further, the frontward direction 51 and the rearward direction 52 will be correctively referred to as a front-rear direction. The upward direction 54 and the downward direction 53 will be collectively referred to as an up-down direction. The rightward direction 55 and the leftward direction 56 will be collectively referred to as a left-right direction.

Further, in the upright posture of the ink cartridge 30, the left-right direction is a widthwise direction of the ink cartridge 30, the up-down direction is a height direction of the ink cartridge 30, and the left-right direction is a depthwise direction of the ink cartridge 30.

In the upright posture, the ink cartridge 30 is inserted frontward through the opening 112 (see FIGS. 6 through 8) and is attached to the cartridge attachment section 110 (see FIG. 9). In the upright posture, the ink cartridge 30 is extracted rearward from the cartridge attachment section 110.

The ink cartridge 30 stores therein ink that can be used in the printer 10. As illustrated in FIG. 1, in the attachment state of the ink cartridge 30, the ink cartridge 30 and the recording head 21 are connected by the corresponding one of the ink tubes 20. The recording head 21 includes sub-tanks 28. Each of the sub-tanks 28 is configured to temporarily store therein ink supplied from the corresponding ink cartridge 30 through the corresponding ink tube 20.

The recording head 21 is configured to selectively discharge the ink supplied from the respective sub-tanks 28 through nozzles 29 according to an inkjet recording scheme. Specifically, the recording head 21 includes a head control board (not illustrated) and a plurality of piezoelectric elements 29A provided in one-to-one correspondence with the nozzles 29. The head control board is configured to selectively apply drive voltages to respective piezoelectric elements 29A to eject the ink through the nozzles 29.

The printer 10 includes a sheet feeding tray 15, a sheet feeding roller 23, a pair of conveying rollers 25, a platen 26, a pair of discharge rollers 27, and a sheet discharge tray 16. A recording sheet is fed from the sheet feeding tray 15 to a sheet conveying path 24 by the sheet feeding roller 23, and is then conveyed onto the platen 26 by the pair of conveying rollers 25. The recording head 21 selectively ejects ink onto the recording sheet that moves past the platen 26 to form an image on the recording sheet. The recording sheet that has passed through the platen 26 is finally discharged by the pair of discharge rollers 27 onto the sheet discharge tray 16 positioned at a most downstream end in the sheet conveying path 24.

<Cartridge Attachment Section 110>

Figure 2:
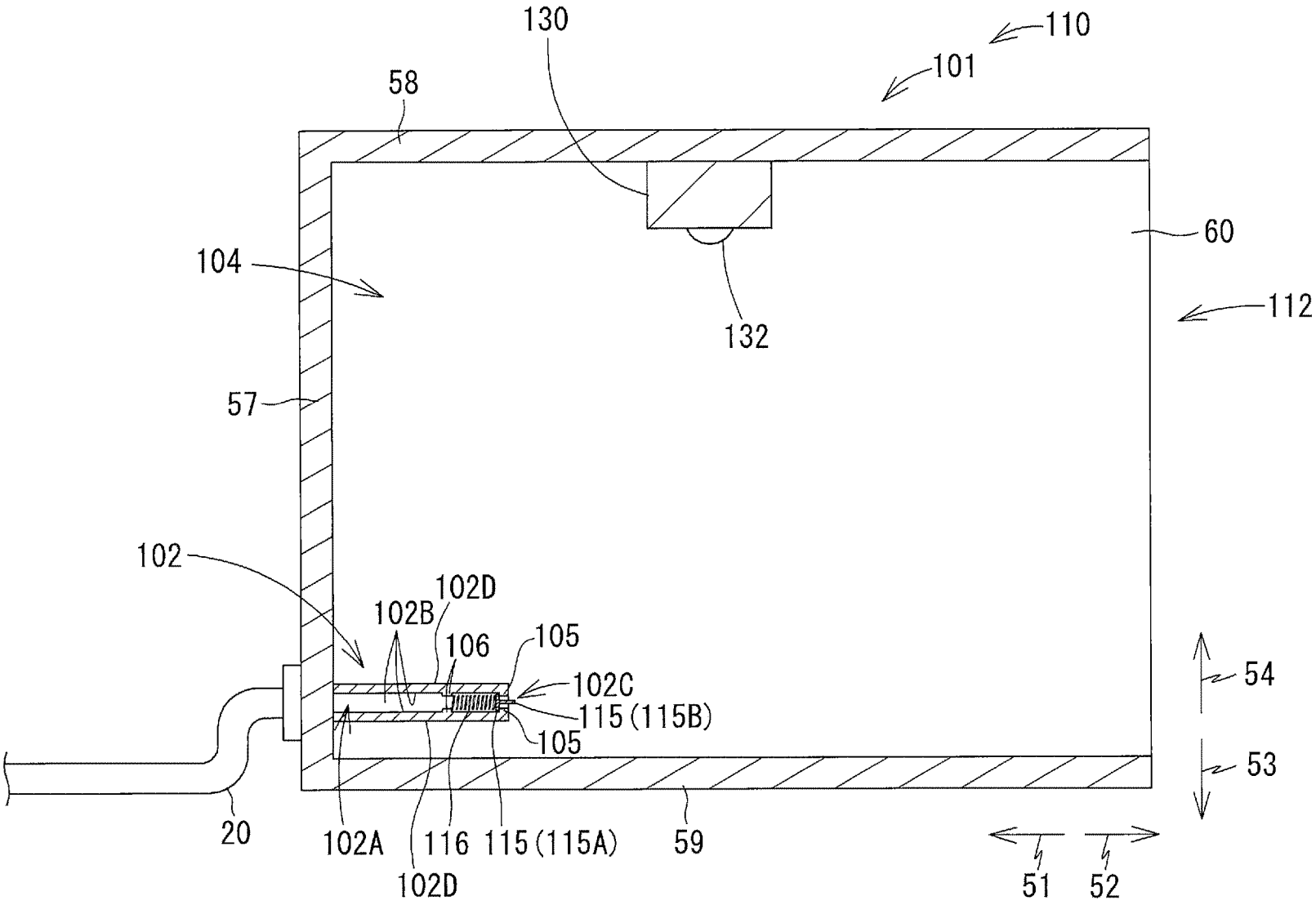
FIG. 2 is a vertical cross-sectional view illustrating a cartridge attachment section 110 according to the embodiment.

As illustrated in FIG. 2, the cartridge attachment section 110 includes the cartridge holder 101, tubular members 102, and connectors 130.

The cartridge holder 101 illustrated in FIG. 2 constitutes a casing of the cartridge attachment section 110. The cartridge holder 101 has a box shape, and defines an internal space 104 therein.

As illustrated in FIG. 2, the cartridge holder 101 includes an end wall 57, a bottom wall 59, a top wall 58, and a pair of side walls 60. The bottom wall 59 extends rearward from a lower end portion of the end wall 57. The top wall 58 is spaced away from the bottom wall 59 in the up-down direction and extends rearward from an upper end portion of the end wall 57.

The respective side walls 60 extend rearward from right and left end portions of the end wall 57. One of the side walls 60 extending from the right end portion of the end wall 57 is connected to respective right end portions of the bottom wall 59 and the top wall 58, and the remaining one of the side walls 60 extending from the left end portion of the end wall 57 is connected to respective left end portions of the bottom wall 59 and the top wall 58. That is, the side walls 60 are spaced away from each other in the left-right direction, and respectively connected to the top wall 58 and the bottom wall 59.

The cartridge holder 101 has a rear end opposite the end wall 57. The rear end has the opening 112 in communication with the internal space 104 of the cartridge holder 101. A user faces the opening 112 when using the printer 10.

The internal space 104 of the cartridge holder 101 is defined by the end wall 57, the bottom wall 59, the top wall 58, and the pair of side walls 60. The internal space 104 is partitioned into four individual chambers by partitioning walls (not illustrated). The tubular member 102 and the connector 130 are provided for each one of the four chambers of the internal space 104. However, the number of the chambers formed in the internal space 104 is not limited to four.

In the following description, for simplifying the explanation, detailed description will be made only on a configuration in one of the four chambers in the internal space 104 of the cartridge attachment section 110 unless otherwise specified.

The tubular member 102 is a hollow cylindrical member made of resin. As illustrated in FIG. 2, the tubular member 102 is provided at a lower portion of the end wall 57 to extend rearward therefrom. The tubular member 102 has a rear end portion (tip end portion) that has an open end 102C and a front end portion (base end portion) that has an open end. The ink tube 20 is connected to the front open end, and the rear open end 102C is open to an outside of the tubular member 102 (the chamber in the internal space 104). That is, the tubular member 102 has an internal space 102A in communication with the outside through the open end 102C.

The tubular member 102 has an inner peripheral surface 102B on which ribs 105 and 106 are provided. Each of the ribs 105 and 106 protrudes radially inward from the inner peripheral surface 102B of the tubular member 102 and extends in a circumferential direction thereof. The rib 105 is provided at the tip end portion of the tubular member 102, and the rib 106 is provided further frontward than the rib 105. That is, the rib 106 is positioned closer to the base end portion of the tubular member 102 than the rib 105 is to the base end portion.

The tip end portion of the tubular member 102 (specifically, the portion on which the rib 105 is provided) is formed with a notch (not illustrated) extending from an outer peripheral surface 102D of the tubular member 102 to the inner peripheral surface 102B. Hence, the internal space 102A is in communication with the outside not only through the open end 102C but also through the notch.

A valve 115 and a coil spring 116 are accommodated in the internal space 102A of the tubular member 102.

The valve 115 includes a plate portion 115A extending in the up-down direction and the left-right direction, and a protruding portion 115B protruding rearward from the plate portion 115A. The plate portion 115A has a circular plate-like shape having a diameter smaller than an inner diameter of a portion of the inner peripheral surface 102B at which the rib 105 and the rib 106 are not provided. The protruding portion 115B has a rod shape extending in the front-rear direction.

Figure 6:
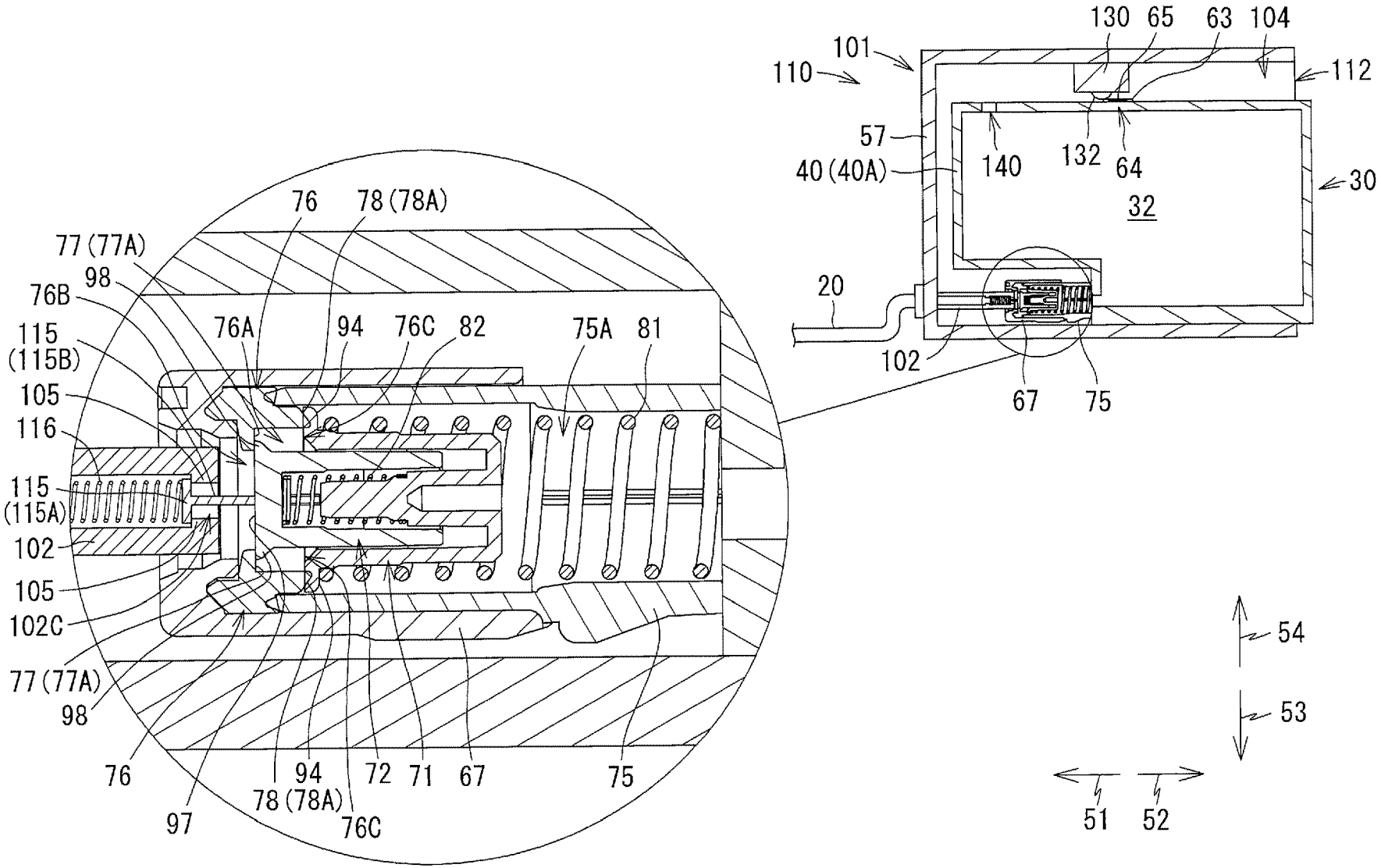
FIG. 6 is a vertical cross-sectional view of the ink cartridge 30 and the cartridge attachment section 110 according to the embodiment, and particularly illustrating an initial state of a process of attachment of the ink cartridge 30 to the cartridge attachment section 110.
Figure 7:
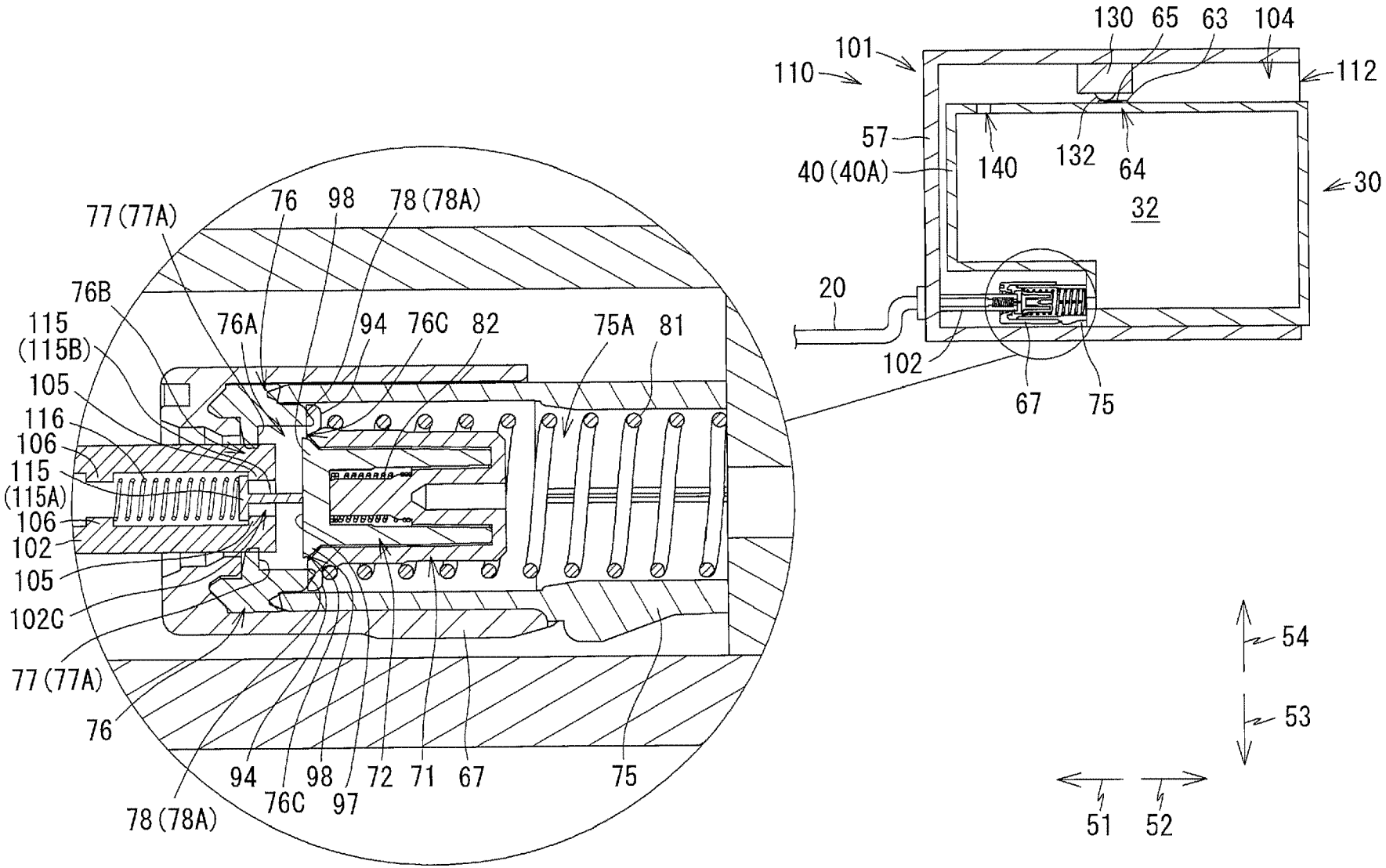
FIG. 7 is a vertical cross-sectional view of the ink cartridge 30 and the cartridge attachment section 110 according to the embodiment, and illustrating a state after the state illustrated in FIG. 6 in the process of attachment of the ink cartridge 30 to the cartridge attachment section 110.
Figure 8:
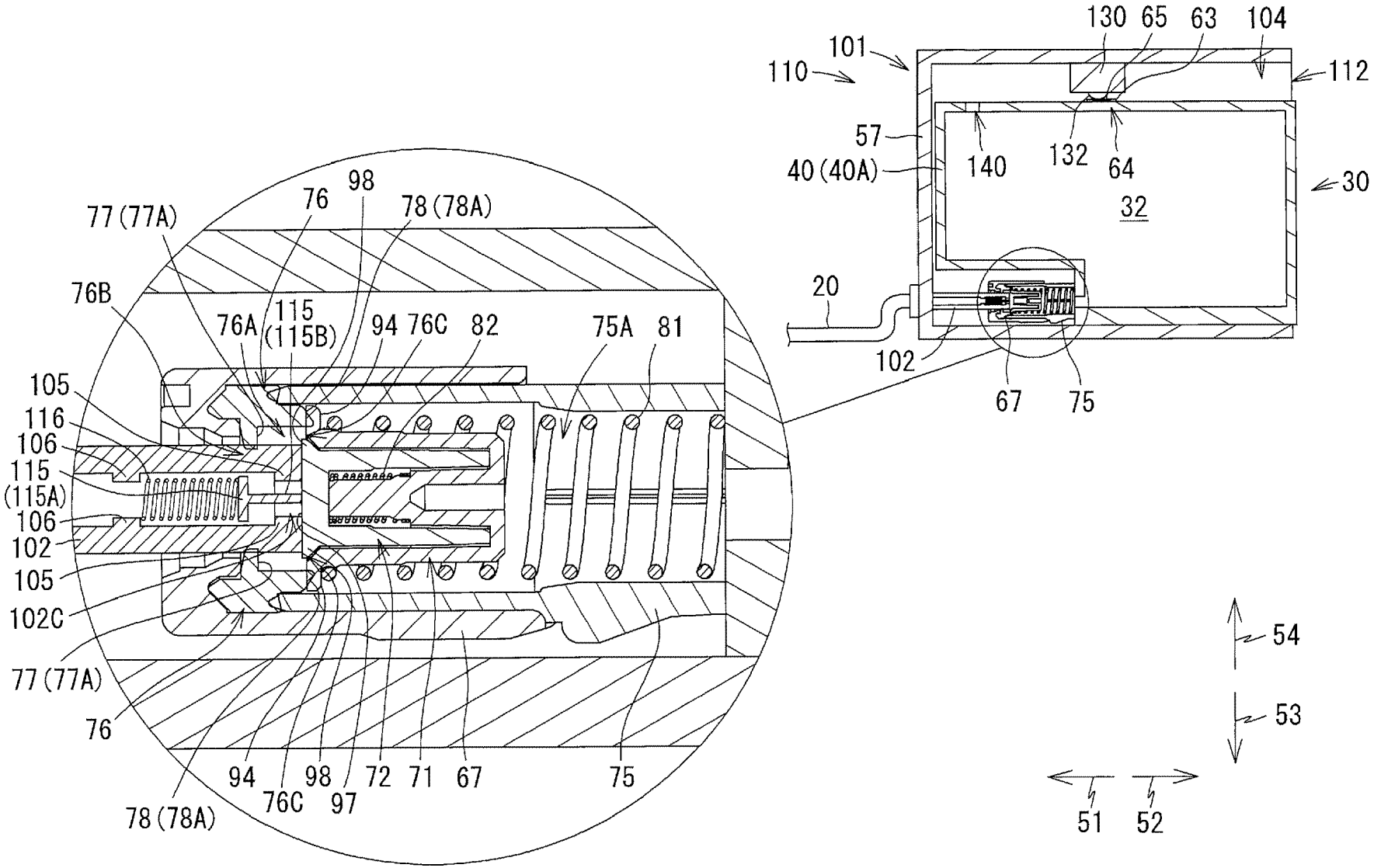
FIG. 8 is a vertical cross-sectional view of the ink cartridge 30 and the cartridge attachment section 110 according to the embodiment, and illustrating a state after the state illustrated in FIG. 7 in the process of attachment of the ink cartridge 30 to the cartridge attachment section 110.

The valve 115 is movable in the front-rear direction between a closed position illustrated in FIGS. 6 and 7 and an open position illustrated in FIGS. 8 and 9 to close and open the open end 102C of the tubular member 102. As illustrated in FIG. 6, when the valve 115 is at the closed position, the plate portion 115A of the valve 115 is in abutment against the rib 105 from the front side thereof to close the open end 102C. That is, the tip end portion of the tubular member 102 is closed. Further, when the valve 115 is at the closed position, a tip end portion (rear end portion) of the protruding portion 115B protrudes further rearward than the tip end portion of the tubular member 102 through the open end 102C.

On the other hand, when the valve 115 is at the open position as illustrated in FIG. 8, the plate portion 115A is separated from the rib 105, thereby opening the open end 102C. That is, the tip end portion of the tubular member 102 is opened. Further, when the valve 115 is at the open position, the entire of the valve 115 is positioned within the internal space 102A of the valve 115.

As illustrated in FIG. 2, the coil spring 116 is positioned further frontward than the valve 115. Specifically, the coil spring 116 has a front end connected to the rib 106, and a rear end connected to the plate portion 115A of the valve 115. The coil spring 116 urges the valve 115 rearward, i.e., toward the closed position. Hence, the valve 115 is maintained at the closed position when no external force is applied to the valve 115 (i.e., when the ink cartridge 30 is not attached to the cartridge holder 101).

As illustrated in FIG. 2, the connector 130 is provided at the top wall 58 of the cartridge holder 101. Four contacts 132 are provided on the connector 130. The four contacts 132 are arranged to be spaced apart from one another in the left-right direction (far side and near side in FIG. 2). The contacts 132 are provided in one-to-one correspondence with electrodes 65 (see FIG. 3) of a circuit board 64 (described later) of the ink cartridge 30. Note that the number of the contacts 132 need not be limited to four.

The contacts 132 are made from material having electrically conductivity and elasticity. The contacts 132 protrude downward from the connector 130. As illustrated in FIG. 1, the contacts 132 are electrically connected to a controller 1 of the printer 10 by a cable 5. The controller 1 includes a CPU and a memory, and is configured to control operations in the printer 10.

<Ink Cartridge 30>

Figure 4:
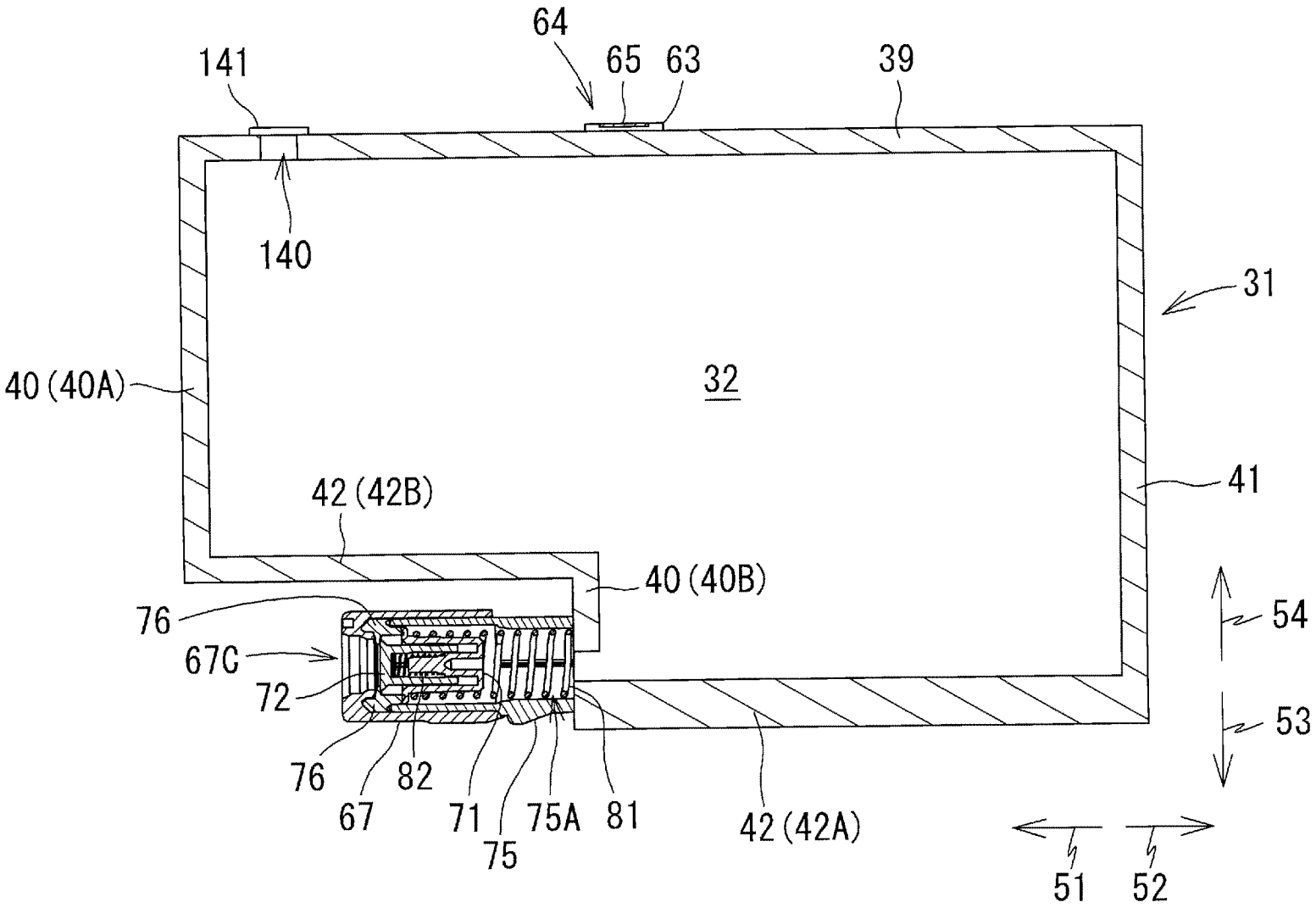
FIG. 4 is a vertical cross-sectional view of the ink cartridge 30 according to the embodiment in the upright posture.

The ink cartridge 30 illustrated in FIGS. 3 and 4 is a container for storing ink therein. The ink cartridge 30 can be accommodated in the corresponding one of the four chambers in the internal space 104 of the cartridge attachment section 110. That is, four ink cartridges 30 can be accommodated into the cartridge attachment section 110. For example, the four ink cartridges 30 respectively store therein inks for the colors of cyan, magenta, yellow, and black. Note that the number of the ink cartridges 30 that can be accommodated in the cartridge attachment section 110 is not limited to four.

As illustrated in FIGS. 3 and 4, the ink cartridge 30 includes a casing 31, the circuit board 64, an ink supply portion 75, a sealing member 76, a cap 67, a first valve 71, a second valve 72, a first coil spring 81, and a second coil spring 82.

In the following description, the front-rear direction, the up-down direction, and the left-right direction are defined assuming that the ink cartridge 30 is in the upright posture unless otherwise specified.

The casing 31 includes a front wall 40, a rear wall 41, a top wall 39, a bottom wall 42, and a pair of side walls 37 and 38. The front wall 40 and the rear wall 41 are spaced away from each other in the front-rear direction. The top wall 39 is arranged between the front wall 40 and the rear wall 41 and extends from an upper end portion of the front wall 40 to an upper end portion of the rear wall 41. The bottom wall 42 is arranged between the front wall 40 and the rear wall 41, and extends from a lower end portion of the front wall 40 to a lower end portion of the rear wall 41. That is, the top wall 39 and the bottom wall 42 respectively connect the front wall 40 and the rear wall 41 to each other. The top wall 39 and the bottom wall 42 are spaced away from each other in the gravitational direction.

The side walls 37 and 38 are spaced away from each other in the left-right direction. Peripheral edges of the side walls 37 and 38 are connected to the front wall 40, the rear wall 41, the top wall 39, and the bottom wall 42, respectively.

The casing 31 defines an ink storage chamber 32 therein. The ink storage chamber 32 is formed between the front wall 40 and the rear wall 41, between the top wall 39 and the bottom wall 42, and between the side walls 37 and 38.

In the upright posture of the ink cartridge 30, a direction from the rear wall 41 to the front wall 40 is equivalent to the frontward direction 51, a direction from the front wall 40 to the rear wall 41 is equivalent to the rearward direction 52, a direction from the top wall 39 to the bottom wall 42 is equivalent to the downward direction 53, a direction from the bottom wall 42 to the top wall 39 is equivalent to the downward direction 53, a direction from the bottom wall 42 to the top wall 39 is equivalent to the upward direction 54, a direction from the side wall 38 to the side wall 37 is equivalent to the rightward direction 55, and a direction from the side wall 37 to the side wall 38 is equivalent to the leftward direction 56.

The front wall 40 is configured of a front wall 40A and a front wall 40B positioned rearward of the front wall 40A. The bottom wall 42 is configured of a bottom wall 42A and a bottom wall 42B positioned upward of the bottom wall 42A. The bottom wall 42B is connected to a lower end portion of the front wall 40A and extends rearward. The bottom wall 42A and the bottom wall 42B are connected to each other through the front wall 40B.

The ink cartridge 30 has an overall flattened shape in which an up-down dimension thereof is smaller than a front-rear dimension thereof, and the up-down dimension and the front-rear dimension are greater than a left-right dimension.

The ink cartridge 30 is configured to be inserted in the frontward direction 51 into and attached to the cartridge holder 101 and extracted in the rearward direction 52 from the cartridge holder 101 through the opening 112 (see FIG. 2).

As illustrated in FIG. 4, an air communication port 140 is formed in the top wall 39 of the casing 31. The air communication port 140 is sealed with a seal 141 in a state prior to insertion of the ink cartridge 30 into the cartridge holder 101. The seal 141 can be peeled off the air communication port 140 of the top wall 39. By peeling the seal 141 off the air communication port 140 before insertion of the ink cartridge 30 into the cartridge holder 101, the ink storage chamber 32 is able to communicate with the atmosphere via the air communication port 140.

Incidentally, the ink storage chamber 32 may be communicated with the atmosphere through means not involving peeling off of the seal 141. For example, a valve may be provided in the air communication port 140 so as to realize switching of a status of the ink storage chamber 32 between a communication state in communication with the atmosphere and a non-communication state out of communication with the atmosphere.

As illustrated in FIGS. 3 and 4, the circuit board 64 is mounted on the top wall 39. The circuit board 64 includes a substrate 63, a memory (not illustrated), and the electrodes 65.

The substrate 63 is a rigid substrate made of glass epoxy and the like. The memory is mounted on the substrate 63, and four electrodes 65 are formed on the substrate 63 to constitute the circuit board 64. Note that the number of the electrodes 65 corresponds to the number of the contacts 132 of the cartridge attachment section 110, and therefore need not be limited to four.

The memory is mounted on a lower surface (a surface facing the top wall 39) of the substrate 63. In the present embodiment, the top wall 39 of the casing 31 has a recess (not illustrated) for accommodating the memory at a position corresponding to the memory when the substrate 63 is mounted on the top wall 39. Incidentally, a position on which the memory is mounted is not limited to the lower surface of the substrate 63.

The memory stores therein information related to the ink cartridge 30 that is readable by the controller 1 (see FIG. 1). The information related to the ink cartridge 30 may be data specifying a lot number, a manufacture date, a color of ink, for example. A semiconductor memory, for example, a non-volatile memory such as FRAM (registered trademark) and a volatile memory such as SRAM can be employed as the memory.

The four electrodes 65 are provided in one-to-one correspondence with the four contacts 132 of the cartridge attachment section 110. As illustrated in FIG. 3, the four electrodes 65 are exposed to the outside so that electrical connection with the electrodes 65 can be established. The electrodes 65 extend in the front-rear direction and are spaced away from one another in the left-right direction. Each of the electrodes 65 is electrically connected to the memory.

Figure 5:
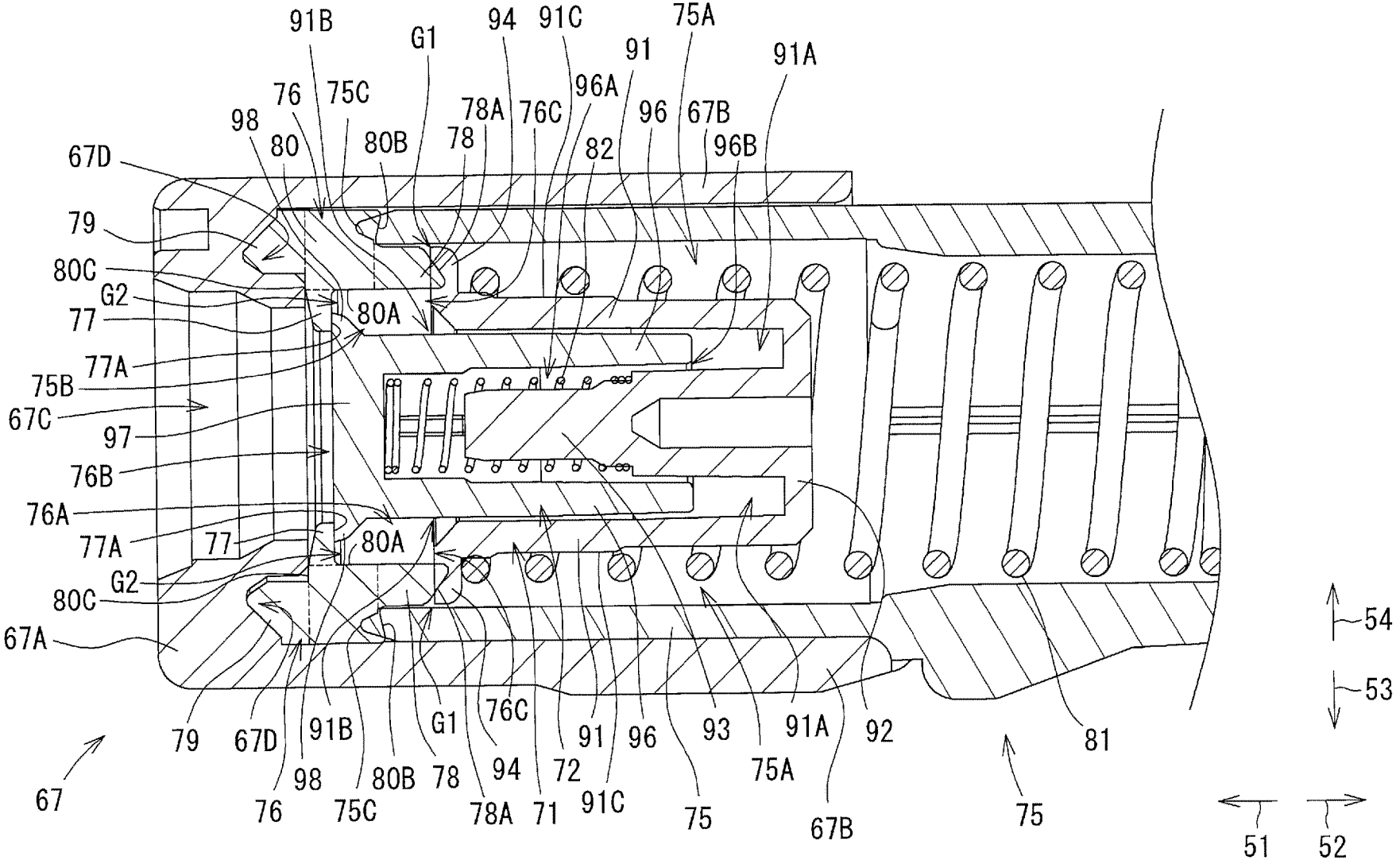
FIG. 5 is an enlarged cross-sectional view illustrating an ink supply portion 75 of the ink cartridge 30 according to the embodiment and a portion in the vicinity thereof those are illustrated in FIG. 4.

As illustrated in FIGS. 3 and 4, the ink supply portion 75 has a hollow cylindrical shape, and protrudes frontward from the front wall 40B of the casing 31. The ink supply portion 75 has a through-hole 75A extending in the front-rear direction. The through-hole 75A has a rear end in communication with the ink storage chamber 32 as illustrated in FIG. 4. As illustrated in FIG. 5, the ink supply portion 75 has a rear end (base end) connected to the casing 31 and a front end (distal end) having a periphery portion 75C defining an opening 75B that is open frontward.

<Sealing Member 76>

As illustrated in FIGS. 4 and 5, the sealing member 76 is a member attached to the front end of the ink supply portion 75. That is, the sealing member 76 is positioned on the periphery portion 75C of the ink supply portion 75. The sealing member 76 is made from an elastic material such as rubber.

As illustrated in FIG. 5, the sealing member 76 includes a base body 80, and protrusions 77, 78 and 79 protruding from the base body 80.

The base body 80 has a ring shape having a through-hole 76A penetrating the sealing member 76 in the front-rear direction at a center portion thereof. The base body 80 has an inner peripheral surface 80A that defines the through-hole 76A.

The protrusion 77 protrudes radially inward of the sealing member 76 from a front end portion of the inner peripheral surface 80A, and extends in a circumferential direction of the sealing member 76. That is, an inner diameter of the front end portion of the through-hole 76A defined by the inner peripheral surface 80A at which the protrusion 77 is provided is smaller than the inner diameter of the remaining portion in the through-hole 76A.

The protrusion 78 protrudes rearward from a rear end surface 80B of the base body 80 and extends in the circumferential direction of the sealing member 76. Specifically, the protrusion 78 protrudes from a portion of the rear end surface 80B that is positioned radially further inward than the remaining portion. The protrusion 78 has an inner peripheral surface continuous with the inner peripheral surface 80A of the base body 80, and defines a part of the through-hole 76A.

The protrusion 79 protrudes frontward from a front end surface 80C of the base body 80 and extends in the circumferential direction of the sealing member 76.

The through-hole 76A has a front open end (opening) 76B in communication with the outside, and a rear open end (opening) 76C in communication with the through-hole 75A of the ink supply portion 75.

The sealing member 76 is in abutment against the ink supply portion 75 from the front side thereof. Specifically, a portion of the rear end surface 80B provided radially outward further than the protrusion 78 is in pressure contact with the periphery portion 75C of the ink supply portion 75 defining the opening 75B. That is, the sealing member 76 is positioned on the periphery portion 75C. The rear end surface 80B of the base body 80 is elastically deformed due to the pressure contact with the periphery portion 75C, thereby providing liquid-tight sealing between the rear end surface 80B of the sealing member 76 and the periphery portion 75C. In this state, the protrusion 78 enters the through-hole 75A of the ink supply portion 75 through the opening 75B.

In a state where the sealing member 76 is in abutment against the ink supply portion 75, the cap 67 is attached to the ink supply portion 75 from the front side thereof. The cap 67 includes a base portion 67A having an annular shape with a through-hole 67C, and a sleeve 67B protruding rearward from a periphery of the base portion 67A. The base portion 67A has a rear surface formed with a groove 67D having a ring shape. In a state where the cap 67 covers the ink supply portion 75, the protrusion 79 of the sealing member 76 is fitted into the groove 67D. With this arrangement, the sealing member 76 is nipped and retained at a position between the ink supply portion 75 and the cap 67 in the front-rear direction.

Note that, although not illustrated in the drawings, the cap 67 includes an engagement portion that can be engaged with the ink supply portion 75 or the casing 31, and engagement between the cap 67 and the ink supply portion 75 or the casing 31 can retain the cap 67 at a position in which the ink supply portion 75 is covered with the cap 67.

In the state where the cap 67 covers the ink supply portion 75, the through-hole 67C of the cap 67 and the through-hole 76A of the sealing member 76 are in communication with each other in the front-rear direction. Hence, the through-hole 75A of the ink supply portion 75 is in communication with the outside through the through-holes 76A and 67C.

Incidentally, instead of the cap 67, an adhesive agent may be used for retaining the sealing member 76 to the ink supply portion 75.

<Valves 71 and 72 and Coil Springs 81 and 82>

As illustrated in FIGS. 4 and 5, the first valve 71, the second valve 72, the first coil spring 81, and the second coil spring 82 are accommodated in the through-hole 75A.

The first valve 71 is supported by the casing 31 through the first coil spring 81 as illustrated in FIG. 5. The first valve 71 includes a sleeve 91, a base portion 92, a protruding portion 93 and a flange 94.

The sleeve 91 has a hollow cylindrical shape defining therein an internal space 91A. The sleeve 91 has a front end formed with an opening 91B and a rear end closed with the base portion 92 having a circular-plate shape.

The protruding portion 93 protrudes frontward from a center portion of a front surface of the base portion 92. The protruding portion 93 has a front end positioned rearward of the front end of the sleeve 91. However, the front end of the protruding portion 93 may be aligned with the front end of the sleeve 91 in the front-rear direction, or may be positioned frontward of the front end of the sleeve 91.

The flange 94 extends radially outward from a front end portion of an outer peripheral surface 91C of the sleeve 91. A gap G1 is formed between an outer peripheral surface of the flange 94 and the inner peripheral surface of the ink supply portion 75, so that the ink can flow through the gap G1.

The first valve 71 is movable in the front-rear direction between a closed position illustrated in FIGS. 6 through 8 and an open position illustrated in FIG. 9 to open and close the opening 76C of the sealing member 76.

When the first valve 71 is at the closed position illustrated in FIG. 6, a front surface of the flange 94 is in abutment against a rear surface 78A of the protrusion 78 of the sealing member 76. Accordingly, the opening 76C is closed to interrupt communication between the through-hole 76A of the sealing member 76 and the through-hole 75A of the ink supply portion 75.

The rear surface 78A is a surface facing rearward. Here, the term "a surface facing rearward" denotes not only a surface completely facing rearward (i.e., perpendicular to the front-rear direction), but also a surface inclined relative to the front-rear direction. In the present embodiment, the rear surface 78A is a tapered surface facing diagonally rearward as illustrated in FIG. 6. The rear surface 78A is positioned radially outward of the inner peripheral surface 80A defining the through-hole 76A of the sealing member 76.

On the other hand, when the first valve 71 is at the open position illustrated in FIG. 9, the flange 94 is in separation from the rear surface 78A of the protrusion 78 of the sealing member 76 to open the opening 76C.

In other words, the first valve 71 is configured to be positioned at one of a position in which the first valve 71 is in abutment against the rear surface 78A of the sealing member 76, and a position in which the first valve 71 is in separation from the rear surface 78A of the sealing member 76.

The first coil spring 81 has a front end connected to the flange 94 as illustrated in FIG. 5, and a rear end connected to the front wall 40B of the casing 31 as illustrated in FIG. 4. That is, the first valve 71 is supported by the casing 31 through the first coil spring 81. The first coil spring 81 urges the first valve 71 frontward. Hence, the first valve 71 is maintained at the closed position when no external force is applied to the first coil spring 81.

An urging force of the first coil spring 81 for urging the first valve 71 frontward is greater than an urging force of the coil spring 116 (see FIG. 2) for urging the valve 115 (see FIG. 2) rearward.

As illustrated in FIG. 5, the second valve 72 is supported by the first valve 71 through the second coil spring 82. The second valve 72 includes a sleeve 96, a base portion 97, and a flange 98.

The sleeve 96 has a hollow cylindrical shape defining an internal space 96A therein. The sleeve 96 has a rear end formed with an opening 96B, and a front end closed with the base portion 97 having a circular plate shape. The sleeve 96 is inserted into the internal space 91A of the sleeve 91 of the first valve 71 through the opening 91B of the sleeve 91. Accordingly, the sleeve 96 is positioned between the sleeve 91 and the protruding portion 93 of the first valve 71 in a radial direction thereof. The flange 98 extends radially outward from a front end portion of the base portion 97. A gap G2 is provided between the flange 98 and the inner peripheral surface 80A of the base body 80 of the sealing member 76 to allow the ink to flow through the gap G2.

The second valve 72 is movable in the front-rear direction. Specifically, the second valve 72 is slidingly movable relative to the first valve 71 between a closed position illustrated in FIG. 6 and an open position illustrated in FIGS. 7 through 9 to close and open the opening 76B of the sealing member 76.

When the second valve 72 is at the closed position illustrated in FIG. 6, a front surface of the flange 98 of the second valve 72 is in abutment against a rear surface 77A of the protrusion 77 of the sealing member 76 from the rear side thereof. Therefore, the opening 76B is closed to interrupt communication between the through-hole 76A of the sealing member 76 and the outside. The term "outside" denotes an outside of the through-hole 76A of the sealing member 76 that is attached to the ink supply portion 75. That is, the term "outside" denotes an outside of the ink cartridge 30.

The rear surface 77A is a surface facing rearward. The term "a surface facing rearward" denotes not only a surface completely facing rearward (i.e., perpendicular to the front-rear direction), but also a surface inclined relative to the front-rear direction. In the present embodiment, the rear surface 77A is a tapered surface facing diagonally rearward.

The rear surface 77A is positioned radially inward of the inner peripheral surface 80A defining the through-hole 76A of the sealing member 76 as illustrated in FIG. 5. Further, the rear surface 77A is positioned frontward of the rear surface 78A of the protrusion 78. That is, the rear surface 78A is positioned closer to the base end of the ink supply portion 75 than the rear surface 77A is to the base end of the ink supply portion 75 in the front-rear direction.

On the other hand, when the second valve 72 is at the open position illustrated in FIG. 7, the flange 98 of the second valve 72 is separated from the rear surface 77A of the protrusion 77 of the sealing member 76, thereby opening the opening 76B.

In other words, the second valve 72 is configured to be positioned at one of a position in which the second valve 72 is in abutment against the rear surface 77A of the sealing member 76, and a position in which the second valve 72 is in separation from the rear surface 77A of the sealing member 76.

In the meantime, the second valve 72 is relatively movable in the front-rear direction between an accommodated position illustrated in FIGS. 7 through 9 and a protruding position illustrated in FIG. 6.

In a state where the second valve 72 is in the accommodated position, the sleeve 96 of the second valve 72 is accommodated in the internal space 91A of the first valve 71, whereas the base portion 97 and the flange 98 are not accommodated in the internal space 91A as illustrated in FIG. 7. Note that, in the accommodated position of the second valve 72, at least a part of the second valve 72 may be accommodated in the internal space 91A of the first valve 71. For example, the entire of the second valve 72 may be accommodated in the internal space 91A when the second valve 72 is in the accommodated position.

On the other hand, in a state where the second valve 72 is in the protruding position, a front portion of the sleeve 96 of the second valve 72 protrudes frontward from the first valve 71 to be exposed to the outside as illustrated in FIG. 6. Note that, in the protruding position of the second valve 72, a volume of the second valve 72 accommodated in the internal space 91A of the first valve 71 should be smaller than that in the accommodated position of the second valve 72, and at least a portion of the second valve 72 should protrude from the first valve 71. For example, only the base portion 97 and the flange 98 may protrude frontward from the first valve 71 at the protruding position of the second valve 72, provided that the entire of the second valve 72 is accommodated in the internal space 91A of the first valve 71 in the accommodated position of the second valve 72.

As illustrated in FIG. 5, the second coil spring 82 is accommodated in the internal space 96A of the second valve 72. The second coil spring 82 has a front end connected to the base portion 97 of the second valve 72, and a rear end connected to the protruding portion 93 of the first valve 71. Hence, the second valve 72 is supported by the first valve 71 via the second coil spring 82.

The second coil spring 82 urges the second valve 72 frontward, i.e., toward the protruding position. Accordingly, when no external force is applied to the second valve 72, the second valve 72 is positioned at the protruding position. In this state, the second valve 72 is in the closed position. That is, when in the protruding position relative to the first valve 71, the second valve 72 is in the closed position relative to the opening 76B of the sealing member 76.

An urging force of the second coil spring 82 for urging the second valve 72 frontward is smaller than the urging force of the first coil spring 81 for urging the first valve 71 frontward, and is further smaller than the urging force of the coil spring 116 that urges the valve 115 rearward.

<Operation for Attaching Ink Cartridge 30 to Cartridge Attachment Section 110>

Hereinafter, operations for attaching the ink cartridge 30 to the cartridge attachment section 110 will be described.

In a state where the ink cartridge 30 is not attached to the cartridge holder 101 as illustrated in FIG. 4, communication of the ink storage chamber 32 with the atmosphere is interrupted since the air communication port 140 is closed with the seal 141. Therefore, the seal 141 is peeled the air communication port 140 off prior to attachment of the ink cartridge 30 to the cartridge attachment section 110 to allow the ink storage chamber 32 to communicate with the atmosphere.

Further, in the state prior to attachment of the ink cartridge 30 to the cartridge attachment section 110 illustrated in FIG. 4, both the first valve 71 and the second valve 72 are in their closed positions. Accordingly, the ink stored in the ink storage chamber 32 can be prevented from flowing to the outside of the ink cartridge 30 through the through-hole 75A of the ink supply portion 75, the through-hole 76A of the sealing member 76, and the through-hole 67C of the cap 67.

In the cartridge holder 101 of the cartridge attachment section 110 in which the ink cartridge 30 has not been attached thereto as illustrated in FIG. 2, the valve 115 is at the closed position to close the open end 102C by the urging force of the coil spring 116, and the protruding portion 115B of the valve 115 protrudes further rearward than the tubular member 102.

Then, as illustrated in FIG. 6, the ink cartridge 30 is inserted frontward into the cartridge holder 101 through the opening 112. As a result, the rear end of the protruding portion 115B of the valve 115 is brought into abutment against the base portion 97 of the second valve 72 of the ink cartridge 30 from the front side thereof.

As the ink cartridge 30 is inserted further frontward from the state illustrated in FIG. 6, the tubular member 102 of the cartridge attachment section 110 enters the through-hole 76A of the sealing member 76 as illustrated in FIG. 7. At this time, the outer peripheral surface 102D of the tubular member 102 is brought into intimate contact with the protrusion 77 of the sealing member 76, thereby providing a liquid-tight seal between the ink supply portion 75 and the tubular member 102 to avoid leakage of the ink from the ink cartridge 30 into the cartridge holder 101 and positioning the ink supply portion 75 relative to the tubular member 102.

Further, as the ink cartridge 30 is inserted further frontward from the state illustrated in FIG. 6, the second valve 72 presses the valve 115 and thus an external force directed frontward is applied to the valve 115, and this generates a reaction force directed rearward from the valve 115 to the second valve 72.

As described above, the urging force of the coil spring 116 for urging the valve 115 rearward is greater than the urging force of the second valve 72 for urging the second valve 72 frontward. Therefore, in accordance with the further frontward insertion of the ink cartridge 30 from the position illustrated in FIG. 6, the second valve 72 is pressed rearward by the valve 115 due to the reaction force from the valve 115 to be moved rearward to separate from the rear surface 77A of the protrusion 77 of the sealing member 76 (see FIG. 7). That is, the second valve 72 is moved from the closed position toward the open position to open the opening 76B of the sealing member 76.

The second valve 72 is pressed by the valve 115 to be moved rearward toward the position illustrated in FIG. 7. At this position, the flange 98 of the second valve 72 is brought into abutment against the sleeve 91 of the first valve 71 from the front side thereof, whereby further rearward movement of the second valve 72 from the position illustrated in FIG. 7 can be restricted. That is, the second valve 72 is moved relatively to the first valve 71 from the protruding position to the accommodated position.

As the ink cartridge 30 is inserted further frontward from the state illustrated in FIG. 7, the tubular member 102 of the cartridge attachment section 110 is inserted further into the through-hole 76A of the sealing member 76.

Further, as the ink cartridge 30 is inserted further frontward from the state illustrated in FIG. 7, the first valve 71 presses the valve 115 through the second valve 72 to apply an external force directed frontward to the valve 115. In the meantime, a reaction force directed rearward is applied from the valve 115 to the first valve 71 through the second valve 72. However, since the urging force of the first coil spring 81 for urging the first valve 71 frontward is greater than the urging force of the coil spring 116 for urging the valve 115 rearward as described above, the valve 115 is pressed frontward to be moved frontward relatively to the tubular member 102 by the external force applied from the first valve 71 through the second valve 72.

Therefore, the plate portion 115A of the valve 115 separates from the rib 105 of the tubular member 102 (see FIG. 8). That is, the valve 115 is moved from the closed position to the open position to open the open end 102C. Consequently, the through-hole 76A of the sealing member 76 and the internal space 102A of the tubular member 102 are brought into communication with each other through the rear open end 102C and the notch (not illustrated) formed in the tubular member 102.

The valve 115 is pressed frontward by the first valve 71 through the second valve 72 and is moved frontward relative to the tubular member 102 to a position illustrated in FIG. 8. In this state, the second valve 72 is in abutment against the tubular member 102. Hence, further frontward movement of the valve 115 from the position illustrated in FIG. 8 can be restricted.

As the ink cartridge 30 is inserted further frontward from the position illustrated in FIG. 8, the tubular member 102 of the cartridge attachment section 110 is inserted further into the through-hole 76A of the sealing member 76. Hence, the tip end (the rear end) of the tubular member 102 is positioned further rearward than the rear end (the rear surface 78A of the protrusion 78) of the sealing member 76 as illustrated in FIG. 9.

At this time, as described above, the outer peripheral surface 102D of the tubular member 102 is in intimate contact with the protrusion 77 of the sealing member 76. That is, the tubular member 102 is inserted into the through-hole 76A without any gap therebetween during the process of attachment of the ink cartridge 30 to the cartridge holder 101. Further, the tip end of the tubular member 102 that passed through the sealing member 76 enters the through-hole 75A of the ink supply portion 75.

As the ink cartridge 30 is inserted further frontward from the position illustrated in FIG. 8, the first valve 71 presses the tubular member 102 through the second valve 72 to apply an external force directed frontward to the tubular member 102, and at the same time, a reaction force directed rearward is generated and applied from the tubular member 102 to the first valve 71 through the second valve 72.

Therefore, the first valve 71 and the second valve 72 are pressed rearward by the tubular member 102 due to the reaction force and moved rearward together. Accordingly, the first valve 71 separates from the rear surface 78A of the protrusion 78 of the sealing member 76 (see FIG. 9) to be moved from the closed position to the open position to open the opening 76C, thereby providing communication between the through-hole 76A of the sealing member 76 and the through-hole 75A of the ink supply portion 75. That is, the ink stored in the ink storage chamber 32 can flow into the internal space 102A of the tubular member 102 through the through-hole 75A of the ink supply portion 75, the through-hole 76A of the sealing member 76, and the through-hole 67C of the cap 67.

In this way, the ink cartridge 30 is movable to the attachment position illustrated in FIG. 9. At this position, a front surface of the front wall 40A of the ink cartridge 30 is in abutment against a rear surface of the end wall 57. Hence, further frontward movement of the ink cartridge 30 from the attachment position can be prevented.

As described above, the first valve 71 is positioned at the open position to open the opening 76C when the ink cartridge 30 is in its attachment position. Further, in this state, the circuit board 64 is positioned directly below the contacts 132 of the cartridge attachment section 110, so that each of the electrodes 65 of the circuit board 64 is electrically connected to the corresponding one of the contacts 132. By virtue of this contact, information on the ink cartridge 30 stored in the memory of the circuit board 64 can be transmitted to the controller 1 (see FIG. 1) of the printer 10 through the contacts 132.

Note that, although not illustrated in the drawings, a retaining mechanism configured to retain the ink cartridge 30 at the attachment position is provided at each of the ink cartridge 30 and the cartridge attachment section 110. In order to remove the ink cartridge 30 from the cartridge attachment section 110, the retaining mechanism can be manipulated so that the ink cartridge 30 is no longer retained at the attached position.

For removing the ink cartridge 30 from the cartridge holder 101, the user grasps the ink cartridge 30 and manipulates the retaining mechanism to release the ink cartridge 30 from the attachment position, and pulls the ink cartridge 30 rearward. During the rearward movement of the ink cartridge 30, each of the first valve 71, the second valve 72 and the valve 115 is moved from the open position to the closed position in an order opposite to order of movement from the closed position to the open position.

That is, firstly, the first valve 71 is moved to the closed position to close the opening 76C of the sealing member 76 by the frontward movement of the first valve 71 and the second valve 72 (see FIG. 8). Then, the valve 115 is moved to the closed position to close the open end 102C of the tubular member 102 by the rearward movement of the valve 115 relative to the tubular member 102 (see FIG. 7). Finally, the second valve 72 is moved to the closed position to close the opening 76B of the sealing member 76 by the frontward movement of the second valve 72 (see FIG. 6).

<Advantageous Effects in the Embodiment>

According to the above-described embodiment, both the first valve 71 and the second valve 72 are configured to open and close the through-hole 76A of the sealing member 76. Accordingly, the structure of the ink supply portion 75 and components in the vicinity of the ink supply portion 75 can be simplified and can be made compact.

Assuming that the ink cartridge 30 includes only the first valve 71 (i.e., the ink cartridge 30 does not include the second valve 72), the ink remaining in the through-hole 76A at a position between the rear surface 77A of the protrusion 77 and the rear surface 78A of the protrusion 78 is likely to leak the outside of the ink cartridge 30. However, in the above-described embodiment, since the opening 76B is closed with the second valve 72 and the opening 76C is closed with the first valve 71, a region of the through-hole 76A between the rear surface 77A and the rear surface 78A can be sealed. Accordingly, leakage of the ink remaining in this region can be restricted.

Further, according to the above-described embodiment, the first valve 71 can guide movement of the second valve 72 since the second valve 72 is slidingly movable relative to the first valve 71. Accordingly, deviation in position of the second valve 72 can be suppressed.

Further, since the second valve 72 is supported by the first valve 71 in the above-described embodiment, deviation in position of the second valve 72 can be further suppressed.

Further, according to the above-described embodiment, the second valve 72 can be accommodated in the first valve 71. Therefore, the ink supply portion 75 can be made small.

Further, according to the above-described embodiment, when the valve 115 abuts against the second valve 72 during the process of attachment of the ink cartridge 30 to the cartridge attachment section 110, the second valve 72 is pressed by the valve 115 to be moved rearward while the valve 115 is retained at the closed position. Hence, the tubular member 102 can pass through the through-hole 76A of the sealing member 76 at an earlier timing.

Further, according to the above-described embodiment, during the process of attachment of the ink cartridge 30 to the cartridge attachment section 110, after the valve 115 is moved from the closed position to the open position, the first valve 71 is moved rearward to provide communication between the through-hole 76A and the through-hole 75A. Once the through-hole 76A and the through-hole 75A are brought into communication with each other, the ink stored in the ink storage chamber 32 starts flowing into the through-hole 76A through the through-hole 75A. At this time, since the valve 115 is already moved to the open position, the ink flowing into the through-hole 75A can be smoothly introduced into the internal space 102A of the tubular member 102 through the through-hole 76A.

Modifications

While the description has been made in detail with reference to the embodiments, it would be apparent to those skilled in the art that various changes and modifications may be made thereto.

Although the second valve 72 is supported by the first valve 71 in the above-described embodiment, the second valve 72 may not be supported by the first valve 71. For example, the rear end of the second coil spring 82 may be connected to the front wall 40B of the casing 31 instead of the first valve 71. In the latter case, not only the first valve 71 but also the second valve 72 is supported by the casing 31.

In the above-described embodiment, the second valve 72 is slidingly movable in the front-rear direction relative to the first valve 71 to be relatively movable thereto. Also, the second valve 72 is accommodated in the first valve 71. However, the second valve 72 may not be slidingly movable relative to the first valve 71, nor the second valve 72 may not be accommodated in the first valve 71.

For example, a rear end of the second valve 72 may be positioned further frontward than a front end of the first valve 71. In the latter case, since the first valve 71 and the second valve 72 are spaced apart from each other in the front-rear direction, the second valve 72 is not slidingly movable relative to the first valve 71, and the second valve 72 is not accommodated in the first valve 71.

In the above-described embodiment, the urging force of the first coil spring 81 for urging the first valve 71 frontward is greater than the urging force of the coil spring 116 for urging the valve 115 rearward, and the urging force of the coil spring 116 for urging the valve 115 rearward is greater than the urging force of the second coil spring 82 for urging the second valve 72 frontward. However, the relationship among the urging forces of the coil springs 81, 82 and 116 may not be limited this. For example, the urging force of the coil spring 116 for urging the valve 115 rearward may be smaller than the urging force of the second coil spring 82 for urging the second valve 72 frontward.

In the above-described embodiment, the coil springs are used for urging the first valve 71, the second valve 72, and the valve 115. However, urging members other than the coil spring such as a leaf spring may be available.

In the above-described embodiment, the valve 115 and the coil spring 116 are accommodated in the internal space 102A of the tubular member 102. However, the valve 115 and the coil spring 116 may not be accommodated in the internal space 102A.

In the latter case, during the process of attachment of the ink cartridge 30 to the cartridge holder 101, firstly, the second valve 72 is moved rearward by the tubular member 102, whereupon the second valve 72 is moved from the closed position to the open position to open the opening 76B. At this time, the second valve 72 is moved until the flange 98 of the second valve 72 is brought into abutment against of the first valve 71 from the front side thereof. Then, as the tubular member 102 continues to press to the second valve 72, the first valve 71 and the second valve 72 is integrally moved. In this way, the first valve 71 is moved from the closed position to the open position to open the opening 76C.

Although the ink cartridge 30 for use with the inkjet recording printer 10 is used in the above-described embodiment, the present disclosure may employ an ink container such as an ink bottle that stores ink therein. In this case, as first and second valves disposed in an ink supply portion of the ink bottle are moved, the ink supply portion of the ink bottle and a printer are brought into communication with each other to allow ink stored in the ink bottle to flow into the printer.

Further, the ink cartridge 30 according to the embodiment is configured to be inserted in the frontward direction 51 and attached to the cartridge attachment section 110, and extracted from the cartridge attachment section 110 in the rearward direction 52. However, the ink cartridge (ink container storing ink therein) may be configured to be inserted in a direction other than the frontward direction 51, and extracted in a direction other than the rearward direction 52. For example, the ink cartridge (ink container storing ink therein) may be configured to be inserted into the cartridge attachment section in the downward direction 53 (the gravitational direction), and extracted from the cartridge attachment section in the upward direction 54, for example. In this case, the ink supply portion of the ink cartridge extends downward, and the first and second valves are movable in the up-down direction.

In the above-described embodiment, ink serves as an example of the liquid. However, instead of the ink, pretreatment liquid configured to be ejected on the sheet prior to the ejection of the ink for printing may be stored in the liquid cartridge. As an alternative, cleaning liquid for cleaning the recording head 21 may be stored in the liquid cartridge.

<Remarks>

The ink cartridge 30 is an example of a liquid cartridge. The ink cartridge 30 is also an example of a liquid container. The casing 31 is an example of a cartridge body. The casing 31 is also example of a housing. The ink storage chamber 32 is an example of a liquid storage chamber. The ink supply portion 75 is an example of a liquid supply portion. The frontward direction 51 is an example of a frontward direction. The rearward direction 52 is an example of a rearward direction. The downward direction 53 is an example of a gravitational direction. The opening 75B is an example of an opening of the liquid supply portion. The through-hole 75A is an example of a liquid passage. The sealing member 76 is an example of a sealing member. The through-hole 76A is an example of a through-hole of the sealing member. The periphery portion 75C is an example of a periphery of the opening. The rear surface 78A is an example of a first surface. The rear surface 77A is an example of a second surface. The first valve 71 is an example of a first valve. The second valve 72 is an example of a second valve. The first coil spring 81 is an example of a first urging member. The second coil spring 82 is an example of a second urging member. The internal space 91A is an example of an accommodation portion. The accommodated position of the second valve 72 is an example of an accommodated position of the second valve. The protruding position of the second valve 72 is an example of a protruding position of the second valve. The cartridge attachment section 110 is an example of an attachment section. The tubular member 102 is an example of a tubular member. The open end 102C is an example of an open end of the tubular member. The valve 115 is an example of a third valve. The open position of the valve 115 is an example of an open position of the third valve. The closed position of the valve 115 is an example of a closed position of the third valve. The coil spring 116 is an example of a third urging member. The closed position of the first valve 71 is an example of a first abutment position of the first valve. The open position of the first valve 71 is an example of a first separated position of the first valve. The closed position of the second valve 72 is an example of a second abutment position of the second valve. The open position of the second valve 72 is an example of a second separated position of the second valve.

What is claimed is:

1. A liquid cartridge comprising:

a cartridge body defining therein a liquid storage chamber;

a liquid supply portion extending in a frontward direction crossing a gravitational direction from the cartridge body in an upright posture of the liquid cartridge, the liquid supply portion being formed with an opening open frontward in the upright posture, the liquid supply portion defining therein a liquid passage connecting the liquid storage chamber to the opening;

a sealing member formed with a through-hole penetrating the sealing member in the frontward direction in the upright posture, the sealing member being provided on a periphery of the opening of the liquid supply portion, the sealing member having:

a first surface positioned radially outward of a periphery of the through-hole, the first surface facing rearward in the upright posture; and a second surface positioned radially inward of the first surface, the second surface being positioned frontward of the first surface and facing rearward in the upright posture;

a first valve disposed in the liquid passage so as to be movable in the frontward direction and a rearward direction opposite the frontward direction;

a second valve disposed in the liquid passage so as to be movable in the frontward direction and the rearward direction;

a first urging member that urges the first valve frontward; and a second urging member that urges the second valve frontward, wherein the first valve is configured to abut against the first surface by an urging force of the first urging member to interrupt communication between the through-hole and the liquid passage, and wherein the second valve is configured to abut against the second surface by an urging force of the second urging member to interrupt communication between the through-hole and an outside of the liquid supply portion.

2. The liquid cartridge according to claim 1, wherein the second valve is slidingly movable relative to the first valve.

3. The liquid cartridge according to claim 2, wherein the second valve is supported by the first valve.

4. The liquid cartridge according to claim 2, wherein the first valve has an accommodation portion in which at least a portion of the second valve can be accommodated, wherein the second valve is movable relative to the first valve between:

an accommodated position in which at least the portion of the second valve is accommodated in the accommodation portion; and a protruding position in which a portion of the second valve protrudes from the first valve, a volume of a portion of the second valve accommodated in the accommodation portion when the second valve is in the protruding position is smaller than a volume of at least the portion of the second valve accommodated in the accommodation portion when the second valve is in the accommodated position, and wherein, when the second valve is in the protruding position, the second valve abuts against the second surface from a rear side of the second surface.

5. The liquid cartridge according to claim 2, wherein the urging force of the first urging member is greater than the urging force of the second urging member.

6. The liquid cartridge according to claim 1, wherein the first urging member is a coil spring.

7. The liquid cartridge according to claim 1, wherein the second urging member is a coil spring.

8. A system comprising:

a liquid cartridge; and an attachment section to which the liquid cartridge is attachable in a frontward direction crossing the gravitational direction, the liquid cartridge comprising:

a cartridge body defining therein a liquid storage chamber;

a liquid supply portion extending in the frontward direction from the cartridge body in an upright posture of the liquid cartridge, the liquid supply portion being formed with an opening open frontward in the upright posture, the liquid supply portion defining therein a liquid passage connecting the liquid storage chamber to the opening;

a sealing member formed with a through-hole penetrating the sealing member in the frontward direction in the upright posture, the sealing member being provided on a periphery of the opening of the liquid supply portion, the sealing member having:

a first surface positioned radially outward of a periphery of the through-hole, the first surface facing rearward in the upright posture; and a second surface positioned radially inward of the first surface, the second surface being positioned frontward of the first surface and facing rearward in the upright posture;

a first valve disposed in the liquid passage so as to be movable in the frontward direction and a rearward direction opposite the frontward direction;

a second valve disposed in the liquid passage so as to be movable in the frontward direction and the rearward direction;

a first urging member that urges the first valve frontward; and a second urging member that urges the second valve frontward, the attachment section comprising:

a tubular member extending rearward to have an open end in the rearward direction, the tubular member being configured to be inserted into the liquid passage of the liquid supply portion of the liquid cartridge attached to the attachment section;

a third valve disposed in the tubular member and movable between:

an open position in which an entire portion of the third valve is disposed in the tubular member to open the open end; and a closed position in which a portion of the third valve protrudes further rearward than the open end to close the open end; and a third urging member that urges the third valve toward the closed position, wherein the first valve is configured to abut against the first surface by an urging force of the first urging member to interrupt communication between the through-hole and the liquid passage, wherein the second valve is configured to abut against the second surface by an urging force of the second urging member to interrupt communication between the through-hole and an outside of the liquid supply portion, and wherein, during a process of attachment of the liquid cartridge to the attachment section:

the tubular member is inserted through the through-hole while no gap is between the tubular member and the periphery of the through-hole;

the second valve is configured to be pressed by the third valve to be moved rearward to separate from the second surface; and the first valve is configured to be pressed by the tubular member to be moved rearward to separate from the first surface.

9. The system according to claim 8, wherein an urging force of the third urging member is greater than the urging force of the second urging member.

10. The system according to claim 8, wherein an urging force of the third urging member is smaller than the urging force of the first urging member.

11. The system according to claim 8, wherein the third urging member is a coil spring.

12. A liquid container comprising:

a housing defining therein a liquid storage chamber;

a liquid supply portion having an opening and a liquid passage connecting the liquid storage chamber to the opening;

a sealing member formed with a through-hole penetrating the sealing member, the sealing member being provided on a periphery of the opening of the liquid supply portion, the sealing member having:

a first surface positioned radially outward of a periphery of the through-hole; and a second surface positioned radially inward of the first surface;

a first valve disposed in the liquid passage and configured to be positioned at one of:

a first abutment position in which the first valve abuts against the first surface; and a first separated position in which the first valve is separated from the first surface;

a second valve disposed in the liquid passage and configured to be positioned at one of:

a second abutment position in which the second valve abuts against the second surface; and a second separated position in which the second valve is separated from the second surface;

a first urging member that urges the first valve toward the first abutment position; and a second urging member that urges the second valve toward the second abutment position.

13. The liquid container according to claim 12, wherein the liquid supply portion has a base end connected to the housing and a distal end having the opening, the liquid passage extending between the base end of the liquid supply portion and the distal end of the liquid supply portion, wherein the first surface is positioned closer to the base end of the liquid supply portion than the second surface is to the base end of the liquid supply portion, the first surface facing the first valve, and wherein the second surface faces the second valve.

14. The liquid container according to claim 12, wherein the second valve is slidingly movable relative to the first valve.

15. The liquid container according to claim 14, wherein the second valve is supported by the first valve.

16. The liquid container according to claim 14, wherein the first valve has an accommodation portion in which at least a portion of the second valve can be accommodated, wherein the second valve is movable relative to the first valve between:

an accommodated position in which at least the portion of the second valve is accommodated in the accommodation portion; and a protruding position in which a portion of the second valve protrudes from the first valve, a volume of a portion of the second valve accommodated in the accommodation portion when the second valve is in the protruding position is smaller than a volume of at least the portion of the second valve accommodated in the accommodation portion when the second valve is in the accommodated position, and wherein, when the second valve is in the protruding position, the second valve abuts against the second surface.

17. The liquid container according to claim 14, wherein the urging force of the first urging member is greater than the urging force of the second urging member.

18. The liquid container according to claim 12, wherein the first urging member is a coil spring.

19. The liquid container according to claim 12, wherein the second urging member is a coil spring.

* * * * *